US007917050B2

(12) United States Patent
Fujiwara

(10) Patent No.: US 7,917,050 B2
(45) Date of Patent: Mar. 29, 2011

(54) WIRING STRUCTURE FOR AN ELECTRICAL DEVICE AND AN IMAGE FORMING APPARATUS EQUIPPED WITH SUCH A WIRING STRUCTURE

(75) Inventor: Daisuke Fujiwara, Osaka (JP)

(73) Assignee: Kyocera Mita Corporation (JP)

( * ) Notice: Subject to any disclaimer, the term of this patent is extended or adjusted under 35 U.S.C. 154(b) by 83 days.

(21) Appl. No.: 12/471,332

(22) Filed: May 22, 2009

(65) Prior Publication Data

US 2010/0080605 A1 Apr. 1, 2010

(30) Foreign Application Priority Data

Sep. 30, 2008 (JP) ..... 2008-254939

(51) Int. Cl.
*G03G 15/00* (2006.01)

(52) U.S. Cl. ..... 399/90

(58) Field of Classification Search ..... 399/9, 12, 399/13, 75, 90, 107, 110, 116, 117, 119, 399/120, 167
See application file for complete search history.

(56) References Cited

U.S. PATENT DOCUMENTS 7,356,266 B2 * 4/2008 Tokuzaki ..... 399/13

FOREIGN PATENT DOCUMENTS

JP 2007-139889 6/2007

* cited by examiner

*Primary Examiner* — Hoan Tran
(74) *Attorney, Agent, or Firm* — McDonnell Boehnen Hulbert & Berghoff LLP

(57) ABSTRACT

A wiring structure of an image forming apparatus includes a main body frame; a cylindrical motor disposed on the main body frame and having a cylindrical surface, an end surface, and a peripheral edge between the cylindrical surface and the end surface; a wire routed near the motor and along the main body frame; and a flexible sheet member attached along the cylindrical surface of the motor so as to cover at least a part of the peripheral edge and having a shape substantially capable of maintaining the wire in a routed state.

16 Claims, 7 Drawing Sheets

【FIG.1】
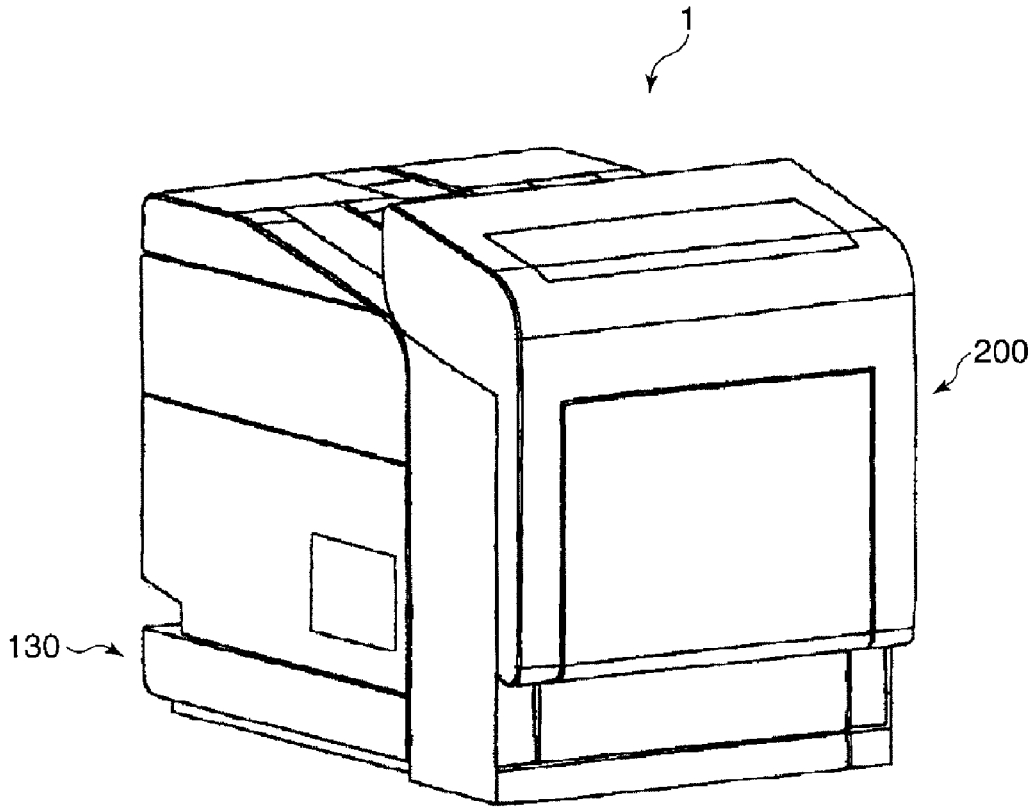

【FIG.2】
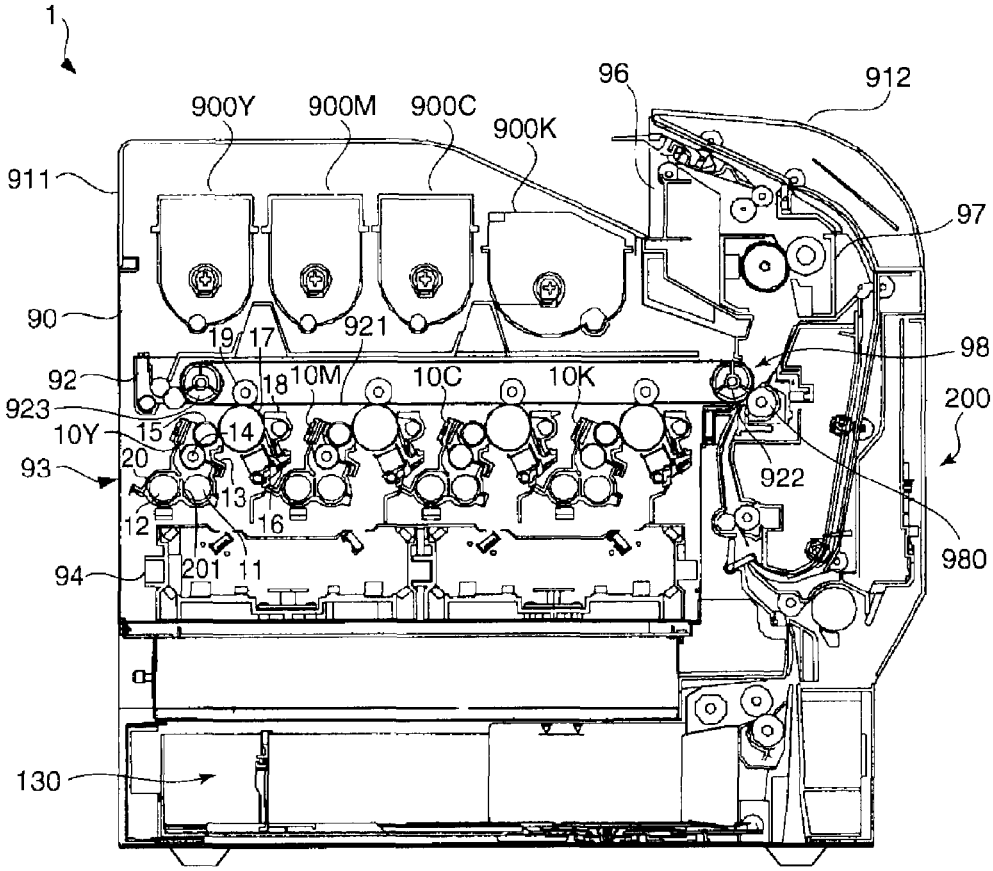

[FIG3]
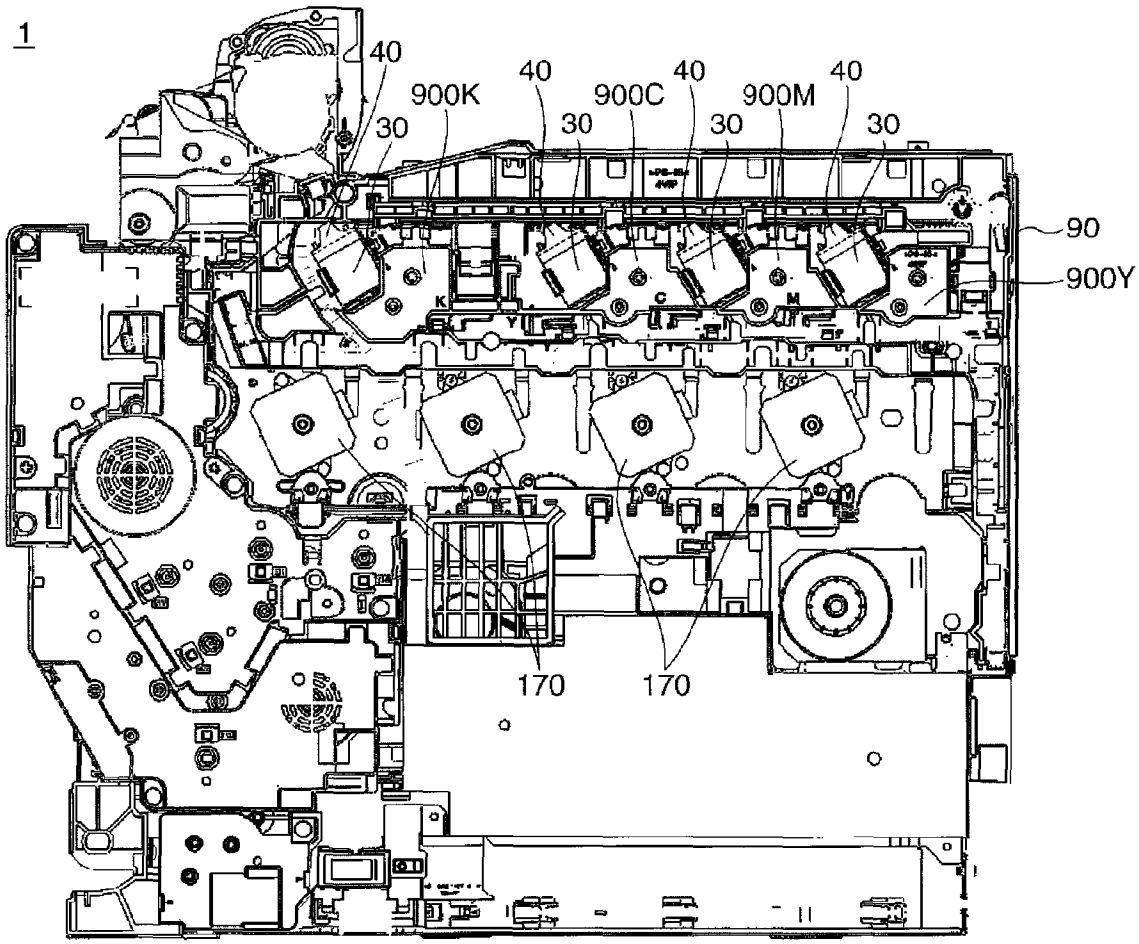

【FIG.4】
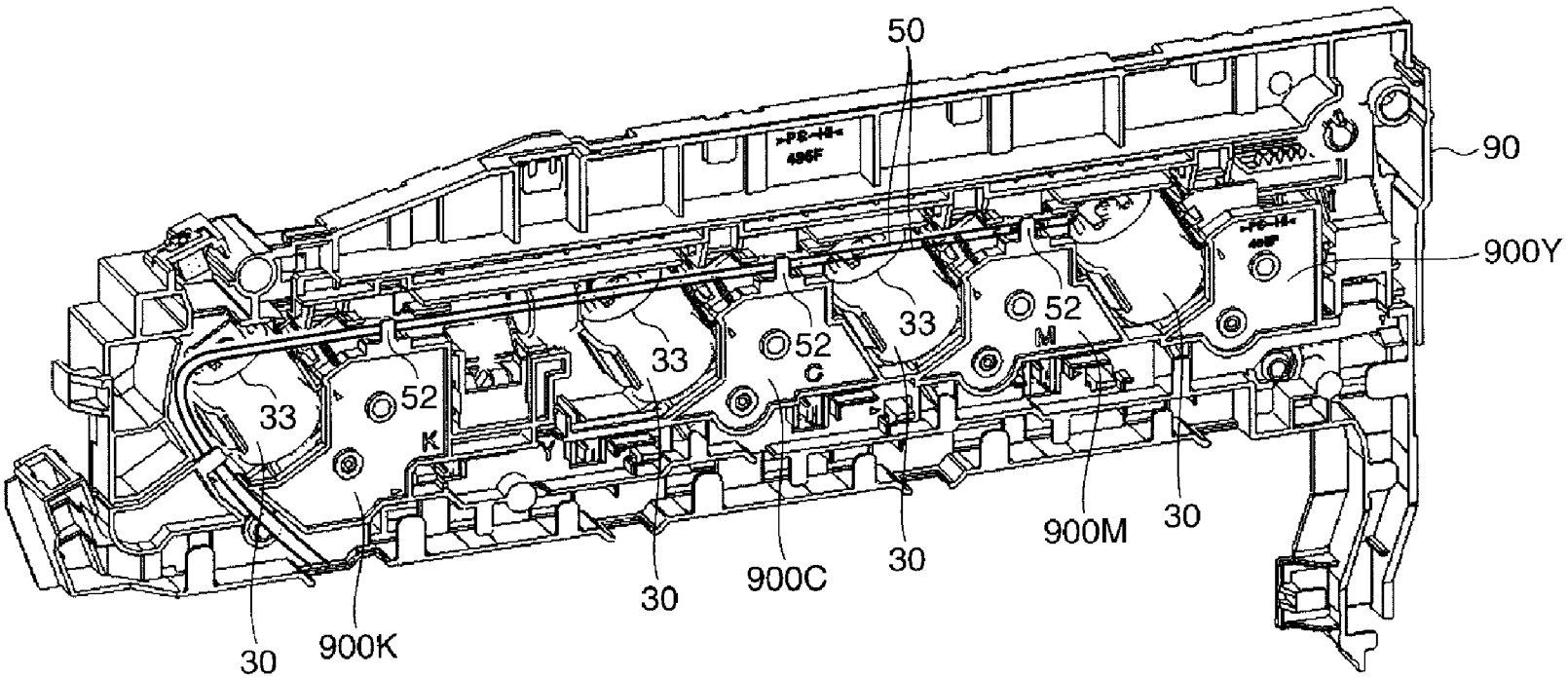

【FIG.5】
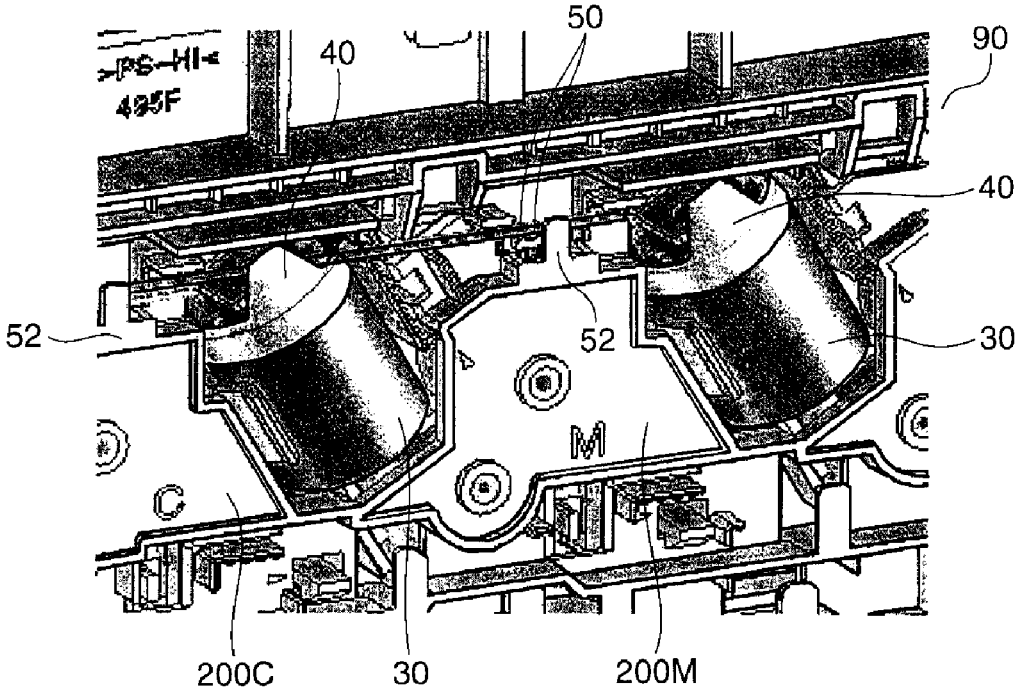

【FIG.6】
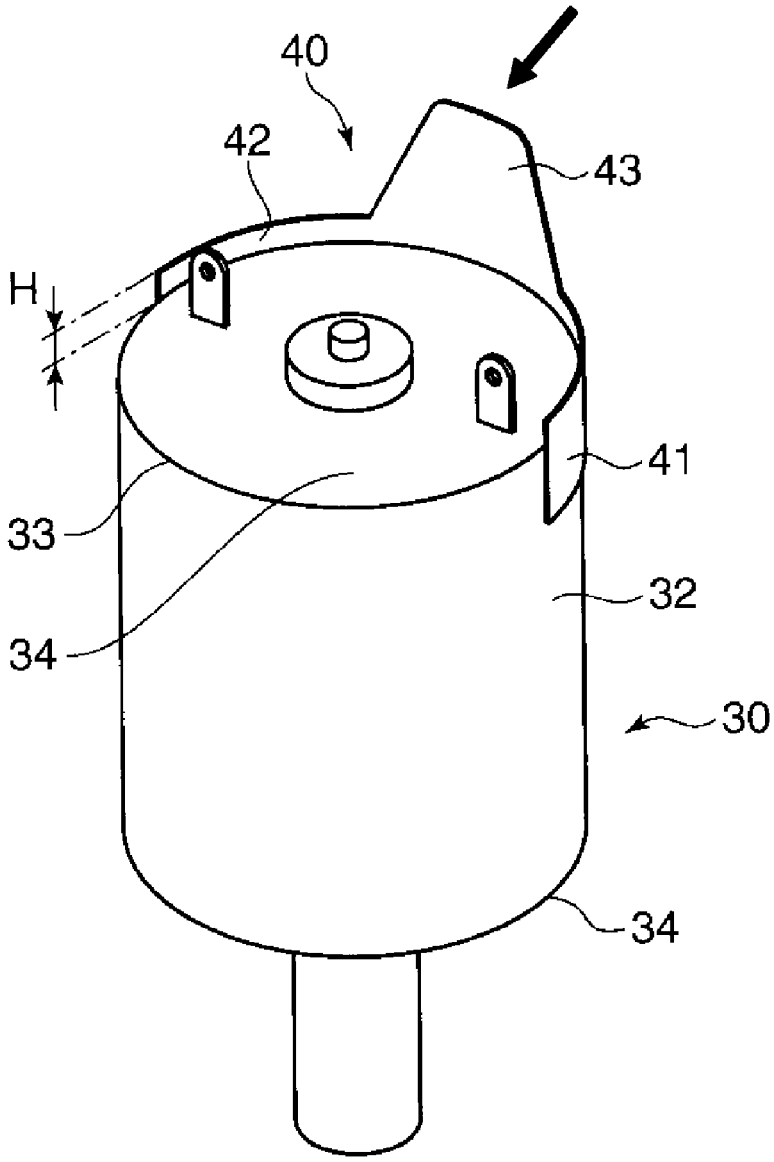

【FIG.7】
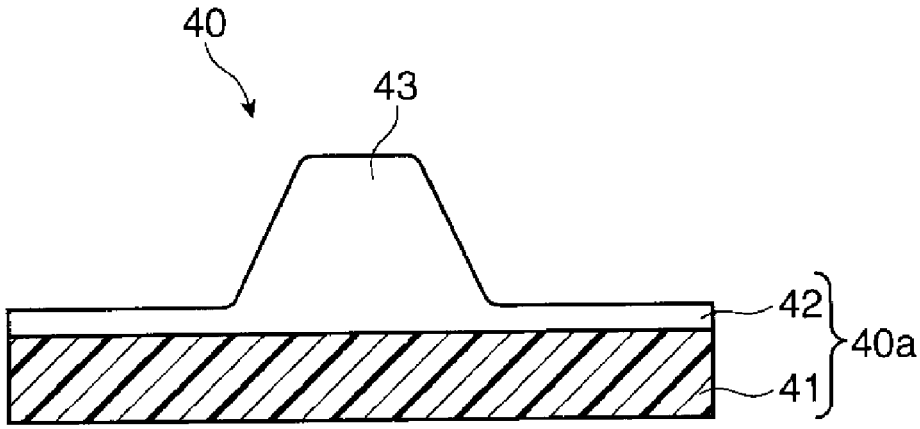

WIRING STRUCTURE FOR AN ELECTRICAL DEVICE AND AN IMAGE FORMING APPARATUS EQUIPPED WITH SUCH A WIRING STRUCTURE

BACKGROUND OF THE INVENTION

1. Field of the Invention

The present invention relates to wiring structures of electrical devices, such as image forming apparatus.

2. Description of the Related Art

In the related art, electrophotographic image forming devices, such as copiers and printers, are known. In such image forming devices, multiple motors are installed, and wires for electrical wiring are routed in a complex manner for the purpose of performing, for example, an image forming process. See Japanese Unexamined Patent Application Publication No. 2007-139889 for an example.

To fulfill demands for color-image forming features and size reduction in image forming devices in recent years, the multiple motors and wires are installed within a small space. In such a condition, the wires routed in the vicinity of the motors can sometimes come into contact with the peripheral edges of the motors. In that case, the wires may possibly become damaged or cut. A damaged or cut wire unfavorably prevents the image forming apparatus from performing a predetermined image forming process.

Accordingly, it is an object of the present invention to provide a wiring structure of an electrical device, such as an image forming apparatus, that allows for easier routing of a wire while preventing the wire from being damaged as a result of coming into contact with a motor.

SUMMARY OF THE INVENTION

In order to achieve the aforementioned object, a wiring structure of an electrical device according to the present invention includes a main body frame; a cylindrical motor disposed on the main body frame and having a cylindrical surface, an end surface, and a peripheral edge between the cylindrical surface and the end surface; a wire routed near the motor and along the main body frame; and a flexible sheet member attached along the cylindrical surface of the motor so as to cover at least a part of the peripheral edge and having a shape substantially capable of maintaining the wire in a routed state.

In the wiring structure of the electrical device according to an embodiment of the present invention, the sheet member covers the peripheral edge of the motor so that the wire is prevented from being damaged by the peripheral edge when routing the wire or installing the motor. On the other hand, because the flexible sheet member, which itself has low rigidity, is attached along the cylindrical surface of the motor, certain rigidity is added to the sheet member. Thus, the wire can be maintained in the routed state by using the sheet member. Consequently, the wiring structure of the electrical device according to the present invention employs the flexible sheet member having low rigidity to prevent the wire from being cut and to maintain the wire in the routed state.

In a preferred embodiment of the present invention, it is preferable that the sheet member integrally have an attachment segment attached along the cylindrical surface of the motor, a contact-prevention segment that extends continuously from the attachment segment and covers the at least a part of the peripheral edge of the motor so as to prevent the peripheral edge and the wire from coming into contact with each other, and a regulating segment that protrudes outward from the contact-prevention segment and has a shape capable of regulating movement of the wire so as to maintain the wire in the routed state.

In another preferred embodiment of the present invention, the sheet member preferably includes a main body having a shape of a strip. In that case, the main body may be constituted by the attachment segment and the contact-prevention segment, and a substantially central section of the contact-prevention segment in a longitudinal direction thereof may be provided with a protrusion that protrudes outward and acts as the regulating segment.

In another preferred embodiment of the present invention, the regulating segment may have the same curvature as the cylindrical surface of the motor when the sheet member is attached along the cylindrical surface of the motor.

In another preferred embodiment of the present invention, the motor is one of a plurality of motors arranged at a certain interval in a horizontal direction with respect to the main body frame, and the sheet member is one of a plurality of sheet members attached to the corresponding motors such that the regulating segments of the sheet members are positionally arranged in the horizontal direction.

In another preferred embodiment of the present invention, the motor may be configured to rotate a rotating member that supplies toner contained in a toner container to a developing unit.

In another preferred embodiment of the present invention, the sheet member may have a thickness of 50 μm to 125 μm. Even with the sheet member formed of such a thin film, the wire still can be prevented from being cut and can be maintained in the routed state.

In another preferred embodiment of the present invention, the attachment segment preferably has an adhesive surface formed with double-sided tape.

In another preferred embodiment of the present invention, the aforementioned wiring structure is applied to an image forming apparatus. Accordingly, in the image forming apparatus, the wire can be prevented from being cut and can be maintained in the routed state.

The wiring structure of the electrical device according to the present invention can allow for easier routing of a wire while preventing the wire from being damaged as a result of coming into contact with a motor.

BRIEF DESCRIPTION OF THE DRAWINGS

FIG. 1 is an external perspective view of an image forming apparatus equipped with a wiring structure according to an embodiment of the present invention, as viewed at an angle from the front-left side;

FIG. 2 is a cross-sectional view showing the internal structure of the image forming apparatus shown in FIG. 1;

FIG. 3 is an external view of a housing of a device body of the image forming apparatus, as viewed from the right side of the image forming apparatus;

FIG. 4 is an enlarged view of a portion of FIG. 3;

FIG. 5 is an enlarged view of a portion of FIG. 4, illustrating the wiring structure in the vicinity of motors in this embodiment;

FIG. 6 illustrates one of the motors and a corresponding sheet member attached to the motor; and FIG. 7 is a plan view showing the sheet member before it is attached to the motor.

DESCRIPTION OF THE PREFERRED EMBODIMENT

A preferred embodiment of the present invention will be described below with reference to the drawings.

FIG. 1 is an external perspective view of an image forming apparatus equipped with a wiring structure according to an embodiment of the present invention, as viewed at an angle from the front-left side. FIG. 2 is a cross-sectional view showing the internal structure of the image forming apparatus. This embodiment is directed to a color printer 1 as an example of the image forming apparatus.

The color printer 1 includes a printer body (i.e., a device body) 200 connected directly or via a local area network (LAN) to, for example, a personal computer (not shown), and a sheet feeder 130 provided below the printer body 200 and capable of storing sheets. The color printer 1 also has other components provided in general color printers, such as a control circuit that controls the operation of the color printer 1.

As shown in FIG. 2, the printer body 200 includes toner containers 900Y, 900M, 900C, and 900K, an intermediate transfer unit 92, an image forming unit 93, an exposure unit 94, a fixing unit 97, an ejecting unit 96, a housing (i.e., a main body frame) 90 of the printer body 200, a top cover 911, and a front cover 912.

The image forming unit 93 has the yellow toner container 900Y, the magenta toner container 900M, the cyan toner container 900C, the black toner container 900K, and developing units 10Y, 10M, 10C, and 10K respectively disposed below the toner containers 900Y, 900M, 900C, and 900K and corresponding to the YMCK colors.

The image forming unit 93 is provided with photosensitive drums 17 for bearing toner images of the four respective colors. The photosensitive drums 17 may be composed of an amorphous silicon (a-Si) based material. The photosensitive drums 17 receive yellow, magenta, cyan, and black toners respectively from the corresponding toner containers 900Y, 900M, 900C, and 900K. Although the image forming unit 93 according to this embodiment is configured to form full-color images, as mentioned above, the image forming unit 93 is not limited to this example and may alternatively be configured to form monochrome images or color images other than full-color images.

Each photosensitive drum 17 is surrounded by, for example, a charger 16, the developing unit 10 (10Y, 10M, 10C, or 10K), a transfer roller 19, and a cleaning unit 18. The charger 16 electrically and uniformly charges the surface of the photosensitive drum 17. The electrically-charged surface of the photosensitive drum 17 is exposed to light by the exposure unit 94, thereby forming an electrostatic latent image. The developing units 10Y, 10M, 10C, and 10K develop the electrostatic latent images formed on the corresponding photosensitive drums 17 by using the color toners supplied from the respective toner containers 900Y, 900M, 900C, and 900K, thereby forming visual images. Each transfer roller 19 forms a nip together with the corresponding photosensitive drum 17 with an intermediate transfer belt 921 interposed therebetween, and primarily transfers the toner image on the photosensitive drum 17 onto the intermediate transfer belt 921. The cleaning units 18 are each configured to clean the peripheral surface of the corresponding photosensitive drum 17 after the toner image is transferred therefrom.

The developing units 10Y, 10M, 10C, and 10K each include a casing 20. This casing 20 holds a two-component developer containing a magnetic carrier and toner. Inside the casing 20, two rotatable stirring rollers 11 and 12 with their longitudinal direction as the axial direction are disposed parallel to each other near the bottom of the casing 20.

A developer circulation path is set at an inner bottom surface of the casing 20, and the stirring rollers 11 and 12 are disposed within this circulation path. A partition wall 201 stands upward from the bottom of the casing 20 and extends between the stirring rollers 11 and 12 in the axial direction thereof. This partition wall 201 is configured to partition the circulation path, such that the circulation path extends around the partition wall 201. The two-component developer is electrically charged while being stirred in and transported through this circulation path by the stirring rollers 11 and 12.

The two-component developer circulates within the casing 20 while being stirred by the stirring rollers 11 and 12. The two-component developer becomes electrically charged, and the two-component developer on the stirring roller 11 is transported upward by being attracted towards a magnetic roller 14 disposed thereabove. The two-component developer attracted to the magnetic roller 14 forms a magnetic brush (not shown) thereon. The layer thickness of the magnetic brush is controlled by a doctor blade 13, and a potential difference between the magnetic roller 14 and a developing roller 15 causes a toner layer to be formed on the developing roller 15. Then, an electrostatic latent image on the photosensitive drum 17 is developed by the toner layer on the developing roller 15.

The exposure unit 94 includes various optical elements, such as a light source, a polygonal mirror, a reflecting mirror, and a deflecting mirror, and emits light based on image data to the peripheral surface of each of the photosensitive drums 17 provided in the image forming unit 93 so as to form an electrostatic latent image.

The intermediate transfer unit 92 includes the intermediate transfer belt 921, a driving roller 922, and a driven roller 923. The toner images from the multiple photosensitive drums 17 are primarily transferred onto the intermediate transfer belt 921 in a superimposed fashion. A secondary transfer roller 980 included in a secondary transfer section 98 and disposed facing the driving roller 922 secondarily transfers the superimposed toner image onto a sheet fed from the sheet feeder 130. The driving roller 922 and the driven roller 923 rotationally drive the intermediate transfer belt 921. The driving roller 922 and the driven roller 923 are rotatably supported by a casing (not shown).

The fixing unit 97 is configured to perform a fixing process on the toner image secondarily transferred onto the sheet, and includes a fixing roller having a built-in heat source and a pressure roller that forms a fixation nip together with the fixing roller. The sheet having undergone the fixing process is conveyed toward the ejecting unit 96 provided at the top of the printer body 200.

The ejecting unit 96 ejects the sheet conveyed from the fixing unit 97 onto the top cover 911 serving as an output tray.

The sheet feeder 130 includes a sheet cassette detachably fitted to the housing 90 of the printer body 200 and a sheet conveying path for conveying sheets stored in the sheet cassette towards the image forming unit 93. In the sheet feeder 130, the sheets are fed one by one to the sheet conveying path by driving, for example, a pickup roller provided in the sheet feeder 130 so that each sheet can be delivered to the image forming unit 93.

FIG. 3 is an external view of a portion of the housing 90 of the printer body 200 accommodating the intermediate transfer unit 92, the image forming unit 93, the exposure unit 94, the fixing unit 97 and the like, as viewed from the right side of the color printer 1. The housing (i.e., the main body frame) 90 also accommodates a plurality of drivers 170 (four drivers 170 in FIG. 3) for driving the respective photosensitive drums 17, and a plurality of motors 30 (four motors 30 in FIG. 3) serving as driving sources for a predetermined image forming process. The motors 30 are DC motors. In this embodiment, the motors 30 are configured to rotate rotating members (not shown), such as stirring members and supply screws, disposed inside the toner containers 900Y, 900M, 900C, and 900K so as to supply toners to the corresponding developing units 10Y, 10M, 10C, and 10K. Accordingly, the motors 30 are disposed adjacent to the corresponding toner containers 900Y, 900M, 900C, and 900K, and the spaces surrounding the motors 30 are extremely small.

FIG. 4 is an enlarged view of a portion of FIG. 3, showing the motors 30 and their surrounding area. As shown in FIG. 4, a wire 50 is routed in the vicinity of the motors 30. In detail, the wire 50 is routed by being guided by guide segments 52 along a wall surface of the housing 90 so as to extend beside the motor 30 located adjacent to the toner container 900Y, the motor 30 located adjacent to the toner container 900M, the motor 30 located adjacent to the toner container 900C, and the motor 30 located adjacent to the toner container 900K. In this manner, the motors 30 and the wire 50 are packed within a small space surrounding the toner containers 900Y, 900M, 900C, and 900K. With this arrangement, the color-image forming feature and size reduction can both be achieved in the color printer 1. However, when installing the motors 30 in the housing 90 or routing the wire 50 along the housing 90, the wire 50 easily tends to come into contact with peripheral edges 33 of the motors 30. This can sometimes cause the wire 50 to become cut or broken. Therefore, in the color printer 1, it is preferable that the wire 50 can be routed readily as well as be prevented from being cut even if the wire 50 and the motors 30 are to be packed within a small space. In light of this, in this embodiment, a sheet member is attached to each of the motors 30 so as to facilitate the routing of the wire 50 as well as to prevent the wire 50 from being cut. Sheet members 40 will be described in detail below. For the sake of convenience, the sheet members 40 attached to the motors 30 are not shown in FIG. 4.

FIG. 5 is an enlarged view of a portion of FIG. 4, illustrating a wiring structure in the vicinity of the motors 30 in this embodiment. FIG. 6 illustrates one of the motors 30 and the corresponding sheet member 40 attached to the motor 30. FIG. 7 is a plan view showing the sheet member 40 before it is attached to the motor 30. Each motor 30 is a cylindrical motor having a cylindrical surface 32, two end surfaces 34, and peripheral edges 33 between the cylindrical surface 32 and the end surfaces 34. On the other hand, the sheet member 40 attached to the motor 30 is a flexible sheet member having a thickness of 50 μm to 125 μm and is attached along the cylindrical surface 32 of the motor 30 so as to cover at least a part of one peripheral edge 33. The sheet member 40 has a shape substantially capable of maintaining the wire 50 in the routed state.

In detail, the sheet member 40 includes a rectangular or strip-like main body 40*a*. The main body 40*a* has an attachment segment 41 having an adhesive surface and attachable to the cylindrical surface 32 of the motor 30 with the adhesive surface, and a contact-prevention segment 42 set to cover at least a part of the peripheral edge 33 of the motor 30 when the attachment segment 41 is attached along the cylindrical surface 32. The adhesive surface of the attachment segment 41 is formed with, for example, double-sided tape.

Since the attachment segment 41 is attached along the cylindrical surface 32 of the motor 30, the attachment segment 41 substantially has the same curvature as the cylindrical surface 32. Therefore, when the attachment segment 41 is attached to the cylindrical surface 32, the contact-prevention segment 42 integrated with the attachment segment 41 also substantially has the same curvature as the cylindrical surface 32. Moreover, in the state where the attachment segment 41 is attached to the cylindrical surface 32, the contact-prevention segment 42 is set to have a height H from the proximate end surface 34 of the motor 30. The contact-prevention segment 42 does not have an adhesive surface.

Since the contact-prevention segment 42 of the sheet member 40 covers the proximate peripheral edge 33 of the motor 30, the wire 50 is prevented from coming into contact with the peripheral edge 33 when routing the wire 50 or installing the motor 30. As a result, the wire 50 can be prevented from being damaged by the peripheral edge 33.

The sheet member 40 also has a protrusion 43 that protrudes in a direction away from the attachment segment 41 from a substantially central section of the contact-prevention segment 42 in the longitudinal direction thereof. The protrusion 43 also substantially has the same curvature as the cylindrical surface 32 of the motor 30 when the attachment segment 41 is attached to the cylindrical surface 32. Since the sheet member 40 is flexible, the protrusion 43 can be bent towards the end surface 34 of the motor 30, as shown with arrow in FIG. 6. When routing the wire 50, the wire 50 is pressed against the protrusion 43 to bend the protrusion 43 inward from the outside of the motor 30 in the radial direction thereof, namely, from the opposite side of the wall surface of the housing 90, so that the wire 50 can be positioned along the wall surface of the housing 90 as well as above the motor 30. After routing the wire 50, the protrusion 43 returns to its original position. Consequently, the wire 50 is routed while being maintained on the protrusion 43.

The wire 50 is routed linearly since the protrusions 43 of the sheet members 40 attached to the motors 30 are arranged in the horizontal direction.

The wire 50 sometimes receives an external force that tries to displace the wire 50 from its predetermined routing position. In that case, the external force is applied to the protrusions 43 via the wire 50. However, since each of the protrusions 43 is bent along the cylindrical surface 32 of the corresponding motor 30 so as to substantially have the same curvature as the cylindrical surface 32, the protrusions 43 have sufficient rigidity against the external force. In consequence, the protrusions 43 can regulate the movement of the wire 50 so as to maintain the wire 50 in the routed state. Therefore, the protrusions 43 act as regulating segments that are capable of maintaining the wire 50 in the routed state. Although the regulating segments substantially have a trapezoidal shape in the drawings, the shape thereof is not limited so long as the regulating segments are capable of maintaining the wire 50 in the routed state.

As is apparent from the above description, the wiring structure of the color printer 1 according to this embodiment employs the flexible sheet members 40 having low rigidity to prevent the wire 50 from being cut and to maintain the wire 50 in the routed state.

What is claimed is:

1. A wiring structure of an electrical device, comprising: a main body frame;

a cylindrical motor disposed on the main body frame and having a cylindrical surface, an end surface, and a peripheral edge between the cylindrical surface and the end surface;

a wire routed near the motor and along the main body frame; and a flexible sheet member attached along the cylindrical surface of the motor so as to cover at least a part of the peripheral edge and having a shape capable of maintaining the wire in a routed state.

2. The wiring structure according to claim 1, wherein the sheet member integrally has an attachment segment attached along the cylindrical surface of the motor, a contact-prevention segment that extends continuously from the attachment segment and covers the at least apart of the peripheral edge of the motor so as to prevent the peripheral edge and the wire from coming into contact with each other, and a regulating segment that protrudes outward from the contact-prevention segment and has a shape capable of regulating movement of the wire so as to maintain the wire in the routed state.

3. The wiring structure according to claim 2, wherein the sheet member includes a main body having a shape of a strip, wherein the main body includes the attachment segment and the contact-prevention segment, and wherein a substantially central section of the contact-prevention segment in a longitudinal direction thereof is provided with a protrusion that protrudes outward, the protrusion acting as the regulating segment.

4. The wiring structure according to claim 2, wherein the regulating segment has substantially the same curvature as the cylindrical surface of the motor when the sheet member is attached along the cylindrical surface of the motor.

5. The wiring structure according to claim 4, wherein the motor rotates a rotating member that supplies toner contained in a toner container to a developing unit.

6. The wiring structure according to claim 2, wherein the motor is one of a plurality of motors arranged at a certain interval in a horizontal direction with respect to the main body frame, and wherein the sheet member is one of a plurality of sheet members attached to the corresponding motors such that the regulating segments of the sheet members are positionally arranged in the horizontal direction.

7. The wiring structure according to claim 2, wherein the attachment segment has an adhesive surface formed with double-sided tape.

8. The wiring structure according to claim 1, wherein the sheet member has a thickness of 50 pm to 125 pm.

9. An image forming apparatus comprising a wiring structure of an electrical device, wherein the wiring structure includes:

a main body frame;

a cylindrical motor disposed on the main body frame and having a cylindrical surface, an end surface, and a peripheral edge between the cylindrical surface and the end surface;

a wire routed near the motor and along the main body frame; and a flexible sheet member attached along the cylindrical surface of the motor so as to cover at least a part of the peripheral edge and having a shape capable of maintaining the wire in a routed state.

10. The image forming apparatus according to claim 9, wherein the sheet member integrally has an attachment segment attached along the cylindrical surface of the motor, a contact-prevention segment that extends continuously from the attachment segment and covers the at least apart of the peripheral edge of the motor so as to prevent the peripheral edge and the wire from coming into contact with each other, and a regulating segment that protrudes outward from the contact-prevention segment and has a shape capable of regulating movement of the wire so as to maintain the wire in the routed state.

11. The image forming apparatus according to claim 10, wherein the sheet member includes a main body having a shape of a strip, wherein the main body includes the attachment segment and the contact-prevention segment, and wherein a substantially central section of the contact-prevention segment in a longitudinal direction thereof is provided with a protrusion that protrudes outward, the protrusion acting as the regulating segment.

12. The image forming apparatus according to claim 10, wherein the regulating segment has substantially the same curvature as the cylindrical surface of the motor when the sheet member is attached along the cylindrical surface of the motor.

13. The image forming apparatus according to claim 12, wherein the motor rotates a rotating member that supplies toner contained in a toner container to a developing unit.

14. The image forming apparatus according to claim 10, wherein the motor is one of a plurality of motors arranged at a certain interval in a horizontal direction with respect to the main body frame, and wherein the sheet member is one of a plurality of sheet members attached to the corresponding motors such that the regulating segments of the sheet members are positionally arranged in the horizontal direction.

15. The image forming apparatus according to claim 10, wherein the attachment segment has an adhesive surface formed with double-sided tape.

16. The image forming apparatus according to claim 9, wherein the sheet member has a thickness of 50 pm to 125 pm.

* * * * *